US009216331B2

(12) United States Patent
Greensmith et al.

(10) Patent No.: US 9,216,331 B2
(45) Date of Patent: Dec. 22, 2015

(54) GOLF CLUB HEAD WITH ADJUSTABLE SOLE

(71) Applicant: Taylor Made Golf Company, Inc., Carlsbad, CA (US)

(72) Inventors: Matthew J. Greensmith, Vista, CA (US); Todd P. Beach, Encinitas, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 161 days.

(21) Appl. No.: 13/829,463

(22) Filed: Mar. 14, 2013

(65) Prior Publication Data

US 2014/0274449 A1 Sep. 18, 2014

(51) Int. Cl.
*A63B 53/04* (2015.01)
*A63B 53/06* (2015.01)

(52) U.S. Cl.
CPC ..... *A63B 53/06* (2013.01); *A63B 53/0466* (2013.01); *A63B 2053/0433* (2013.01)

(58) Field of Classification Search
CPC ..... A63B 53/06; A63B 2053/026; A63B 2053/0433; A63B 53/0466
USPC ..... 473/324–350, 244–248, 287–292
See application file for complete search history.

(56) References Cited

U.S. PATENT DOCUMENTS 782,955 A 2/1905 Emens
796,802 A 8/1905 Brown
1,454,267 A 5/1923 Challis et al.
D63,284 S 11/1923 Challis
1,623,523 A 4/1927 Bourke
1,650,183 A 11/1927 Brooks
1,890,538 A 12/1932 Hadden
1,895,417 A 1/1933 Lard
1,946,134 A 2/1934 Dyce
2,020,679 A 11/1935 Fitzpatrick
2,067,556 A 1/1937 Wettlaufer
2,219,670 A 10/1940 Wettlaufer (Continued)

FOREIGN PATENT DOCUMENTS

GB 2207358 2/1989
GB 2225725 6/1990

(Continued)

OTHER PUBLICATIONS

Photographs of S-God Fairway Club purchased May 28, 2008 (3 pages).

(Continued)

*Primary Examiner* — Sebastiano Passaniti
(74) *Attorney, Agent, or Firm* — Klarquist Sparkman, LLP

(57) ABSTRACT

Described herein are embodiments of golf club heads, such as fairway wood heads, having an adjustable sole. In some embodiments, a club head includes a body, a sole plate, and a platform. The body has a front portion comprising a striking plate, a rear end, a toe, a heel, a crown, and a lower portion opposite the crown. The sole plate is coupled to the lower portion of the body and is pivotably adjustable relative to the body about a pivot location adjacent to the front portion of the body. The platform is positioned between the sole plate and the lower portion of the body and is adjustable, such as frontwardly and rearwardly, to plural positions along the lower portion of the body to change a pivot angle between the sole plate and the body.

20 Claims, 17 Drawing Sheets

(56) References Cited

U.S. PATENT DOCUMENTS 2,225,931 A 12/1940 Sexton
2,464,850 A 3/1949 Crawshaw
3,424,459 A 1/1969 Evancho
3,524,646 A 8/1970 Wheeler
3,742,533 A 7/1973 Brunette
3,829,092 A 8/1974 Arkin
3,840,231 A 10/1974 Moore
3,848,737 A 11/1974 Kenon
3,891,212 A 6/1975 Hill
3,893,670 A 7/1975 Franchi
4,253,666 A 3/1981 Murphy
4,306,721 A 12/1981 Doyle
4,340,227 A 7/1982 Dopkowski
4,498,673 A 2/1985 Swanson
4,506,888 A 3/1985 Nardozzi, Jr.
4,664,382 A 5/1987 Palmer et al.
4,852,782 A 8/1989 Wu et al.
4,854,582 A 8/1989 Yamada
4,895,368 A 1/1990 Geiger
4,943,059 A 7/1990 Morell
4,948,132 A 8/1990 Wharton
5,039,098 A 8/1991 Pelz
5,133,553 A 7/1992 Divnick
5,178,394 A 1/1993 Tanampai
5,184,819 A 2/1993 Desbiolles
5,255,914 A 10/1993 Schroder
5,275,408 A 1/1994 Desbiolles et al.
5,280,923 A 1/1994 Lu
5,365,811 A 11/1994 Chi
5,433,442 A 7/1995 Walker
5,513,844 A 5/1996 Ashcraft et al.
5,533,725 A 7/1996 Reynolds, Jr.
5,540,435 A 7/1996 Kawasaki
5,542,666 A 8/1996 Chou
5,588,921 A 12/1996 Parsick
5,601,149 A 2/1997 Kawasaki et al.
5,626,528 A 5/1997 Toulon
5,645,500 A 7/1997 Borden
5,653,645 A 8/1997 Baumann
5,688,188 A 11/1997 Chappell
5,702,310 A 12/1997 Wozny
5,722,901 A 3/1998 Barron et al.
5,749,790 A 5/1998 Van Alen, II et al.
5,807,186 A 9/1998 Chen
5,839,973 A 11/1998 Jackson
5,851,155 A 12/1998 Wood et al.
5,863,260 A 1/1999 Butler, Jr. et al.
5,906,549 A 5/1999 Kubica
5,931,742 A 8/1999 Nishimura et al.
5,951,411 A 9/1999 Wood et al.
6,039,659 A 3/2000 Hamm
6,089,994 A 7/2000 Sun
6,110,055 A 8/2000 Wilson
6,120,384 A 9/2000 Drake
6,149,533 A 11/2000 Finn
6,251,028 B1 6/2001 Jackson
6,270,425 B1 8/2001 Dyer
6,273,828 B1 8/2001 Wood et al.
6,287,214 B1 9/2001 Satoh
6,352,483 B1 3/2002 Okoshi
6,368,230 B1 4/2002 Helmstetter et al.
6,371,865 B1 4/2002 Magliulo
6,371,866 B1 4/2002 Rivera
6,447,404 B1 9/2002 Wilbur
6,475,100 B1 11/2002 Helmstetter et al.
6,478,691 B2 11/2002 Okoshi
6,514,154 B1 2/2003 Finn
6,547,673 B2 4/2003 Roark
6,569,029 B1 5/2003 Hamburger
6,575,843 B2 6/2003 McCabe
6,620,053 B2 9/2003 Tseng
6,634,957 B2 10/2003 Tseng
6,669,573 B2 12/2003 Wood et al.
6,746,341 B1 6/2004 Hamric, Jr. et al.
6,764,413 B2 7/2004 Ho
6,769,994 B2 8/2004 Boone
6,769,996 B2 8/2004 Tseng
RE38,605 E 9/2004 Kubica et al.
6,789,304 B2 9/2004 Kouno
6,824,475 B2 11/2004 Burnett et al.
6,849,002 B2 2/2005 Rice
6,857,969 B2 2/2005 Rice
6,890,269 B2 5/2005 Burrows
6,899,636 B2 5/2005 Finn
6,926,616 B1 8/2005 Kusumoto et al.
6,966,847 B2 11/2005 Lenhof et al.
6,997,818 B2 2/2006 Kouno
7,014,569 B1 3/2006 Figgers
7,083,529 B2 8/2006 Cackett et al.
7,115,046 B1 10/2006 Evans
7,153,220 B2 12/2006 Lo
D537,896 S 3/2007 Holt et al.
7,241,229 B2 7/2007 Poynoŕ
7,300,359 B2 11/2007 Hocknell et al.
7,316,622 B1 1/2008 Lucas
7,326,126 B2 2/2008 Holt et al.
7,335,113 B2 2/2008 Hocknell et al.
7,344,449 B2 3/2008 Hocknell et al.
7,354,353 B2 4/2008 Hocknell et al.
7,387,577 B2 6/2008 Murphy et al.
7,410,426 B2 8/2008 Willett et al.
7,427,239 B2 9/2008 Hocknell et al.
7,465,239 B2 12/2008 Hocknell et al.
7,476,160 B2 1/2009 Hocknell et al.
D588,661 S 3/2009 Lee
D588,662 S 3/2009 Lee
D588,663 S 3/2009 Lee
D588,664 S 3/2009 Lee
7,658,687 B2 2/2010 Hirano
7,699,717 B2 4/2010 Morris et al.
7,704,155 B2 4/2010 Bennett et al.
7,789,769 B2 9/2010 Sugimoto
7,794,331 B2 9/2010 Tsai et al.
7,846,041 B2 12/2010 Beach et al.
7,846,042 B2 12/2010 Werner et al.
7,854,665 B2 12/2010 Dewhurst et al.
7,871,336 B2 * 1/2011 Breier et al. ..... 473/244
7,874,934 B2 1/2011 Soracco et al.
7,878,921 B2 2/2011 Bennett et al.
7,887,431 B2 2/2011 Beach et al.
7,922,599 B2 4/2011 Yamamoto
7,934,999 B2 * 5/2011 Cackett et al. ..... 473/242
8,025,587 B2 * 9/2011 Beach et al. ..... 473/245
8,235,831 B2 8/2012 Beach et al.
2001/0007835 A1 7/2001 Baron
2002/0037773 A1 3/2002 Wood et al.
2003/0008723 A1 1/2003 Goodman
2004/0018886 A1 1/2004 Burrows
2004/0018887 A1 1/2004 Burrows
2004/0063515 A1 4/2004 Boone
2005/0049067 A1 3/2005 Hsu
2005/0049072 A1 3/2005 Burrows
2005/0079923 A1 4/2005 Droppleman
2005/0192119 A1 9/2005 Beach et al.
2006/0105855 A1 5/2006 Cackett et al.
2006/0287125 A1 12/2006 Hocknell et al.
2007/0078026 A1 4/2007 Holt et al.
2007/0099719 A1 5/2007 Halleck et al.
2007/0105655 A1 5/2007 Beach et al.
2007/0117645 A1 5/2007 Nakashima
2007/0149314 A1 6/2007 Ban et al.
2007/0207877 A1 9/2007 Nishio
2007/0254746 A1 11/2007 Poynoŕ
2007/0265106 A1 11/2007 Burrows
2008/0058114 A1 3/2008 Hocknell et al.
2008/0076590 A1 3/2008 Hsu
2008/0102982 A1 5/2008 Wahl et al.
2008/0119301 A1 5/2008 Holt et al.
2008/0146372 A1 6/2008 John
2008/0254908 A1 10/2008 Bennett et al.
2008/0254909 A1 10/2008 Callinan et al.
2008/0280693 A1 11/2008 Chai
2008/0293510 A1 11/2008 Yamamoto
2009/0011848 A1 1/2009 Thomas et al.

(56) References Cited

U.S. PATENT DOCUMENTS

| | | | |
|---|---|---|---|
| 2009/0011849 | A1 | 1/2009 | Thomas et al. |
| 2009/0011850 | A1 | 1/2009 | Stites et al. |
| 2009/0062029 | A1 | 3/2009 | Stites et al. |
| 2009/0075749 | A1 | 3/2009 | De La Cruz et al. |
| 2009/0118034 | A1 | 5/2009 | Yokota |
| 2009/0143167 | A1 | 6/2009 | Evans |
| 2009/0197699 | A1 | 8/2009 | Morris et al. |
| 2009/0221381 | A1 | 9/2009 | Breier et al. |
| 2009/0239676 | A1 | 9/2009 | Bennett et al. |
| 2009/0239677 | A1 | 9/2009 | DeShiell et al. |
| 2009/0247316 | A1 | 10/2009 | De La Cruz et al. |
| 2010/0048324 | A1 | 2/2010 | Wada et al. |
| 2010/0197422 | A1 | 8/2010 | Thomas et al. |
| 2010/0197423 | A1 | 8/2010 | Thomas et al. |
| 2010/0261543 | A1 | 10/2010 | Breier et al. |
| 2010/0292018 | A1 | 11/2010 | Cackett et al. |
| 2011/0118046 | A1 | 5/2011 | Bennett et al. |

FOREIGN PATENT DOCUMENTS

| | | | |
|---|---|---|---|
| GB | 2241173 | | 8/1991 |
| JP | 4156869 | | 5/1992 |
| JP | 8318008 | | 12/1996 |
| JP | 9164227 | | 6/1997 |
| JP | 2000005349 | | 1/2000 |
| JP | 2003-062131 | | 3/2003 |
| JP | 2006-034906 | | 2/2006 |
| JP | 2006-042951 | | 2/2006 |
| JP | 2008-029691 | A | 2/2008 |
| JP | 4177414 | B | 8/2008 |
| JP | 2008-272274 | A | 11/2008 |
| JP | 2008-272496 | A | 11/2008 |
| JP | 2009112800 | A | 5/2009 |
| JP | 2009-136608 | A | 6/2009 |
| WO | WO2004/009186 | | 1/2004 |
| WO | WO2006/018929 | | 2/2006 |
| WO | WO2006/055386 | | 5/2006 |
| WO | WO2009/035345 | | 3/2009 |

OTHER PUBLICATIONS

Screen Shots from website www.plazagolf.net, printed on May 9, 2011 (5 pages).

* cited by examiner

| Club Head | Loft Setting | Face Angle [°] | | | | |
|---|---|---|---|---|---|---|
| | | Open Change | Open | Neutral | Closed | Closed Change |
| Emb. 1 | Neutral Loft | 2.4 | 3.4 | 1.0 | -1.8 | -2.8 |
| Emb. 2 | | 2.6 | 4.8 | 2.2 | 0.1 | -2.1 |
| Emb. 3 | | 2.8 | 4.6 | 1.8 | -0.1 | -1.9 |
| Emb. 4 | | 2.1 | 4.0 | 1.9 | -0.5 | -2.4 |
| Emb. 5 | | 2.3 | 3.4 | 1.1 | -1.3 | -2.4 |
| Average | | 2.4 | 4.0 | 1.6 | -0.7 | -2.3 |
| Emb. 1 | -1.5° Loft | 3.0 | 5.8 | 2.8 | 0.4 | -2.4 |
| Emb. 2 | | 3.4 | 7.5 | 4.1 | 2.1 | -2.0 |
| Emb. 3 | | 2.8 | 6.8 | 4.0 | 1.7 | -2.3 |
| Emb. 4 | | 2.6 | 6.2 | 3.6 | 1.2 | -2.4 |
| Emb. 5 | | 1.8 | 5.0 | 3.2 | -0.2 | -3.4 |
| Average | | 2.7 | 6.3 | 3.5 | 1.0 | -2.5 |
| Emb. 1 | +1.5° Loft | 2.3 | 0.9 | -1.4 | -2.9 | -1.5 |
| Emb. 2 | | 1.8 | 1.0 | -0.8 | -3.9 | -3.1 |
| Emb. 3 | | 2.2 | 1.2 | -1.0 | -3.4 | -2.4 |
| Emb. 4 | | 2.3 | 0.6 | -1.7 | -4.1 | -2.4 |
| Emb. 5 | | 2.6 | -0.1 | -2.7 | -4.9 | -2.2 |
| Average | | 2.2 | 0.7 | -1.5 | -3.8 | -2.3 |

FIG. 30

GOLF CLUB HEAD WITH ADJUSTABLE SOLE

FIELD

This disclosure is related to golf club heads having an adjustable sole.

BACKGROUND

For a given type of golf club, the golfing consumer has a wide variety of variations to choose from. Variations available for a given wood-type golf club, for example, can include left or right handedness, variations in loft angle, and variations in shaft length and shaft flexibility.

Having such a large number of variations available for a single golf club, golfing consumers can purchase clubs with club property combinations that suit their needs. However, shafts and club heads are generally manufactured separately, and once a shaft is attached to a club head, usually by an adhesive, replacing either the club head or shaft is not easily done by the consumer. Typically, these modifications must be made by a technician at a pro shop. The attendant cost and time spent without clubs may dissuade golfers from modifying their clubs as often as they would like, resulting in a less-than-optimal golfing experience. Further, the loft angle of a club often cannot be changed after manufacturing. Thus, there is a need in the art to provide golf clubs that can be readily adjusted by the consumer.

SUMMARY

Described herein are embodiments of golf club heads, particularly fairway wood heads, having an adjustable sole. The club head includes a body, a sole plate, and a platform. The body has a front portion comprising a striking plate, a rear end, a toe, a heel, a crown, and a lower portion opposite the crown. In some embodiments, the sole plate is coupled to the lower portion of the body and is pivotably adjustable relative to the body about a pivot location adjacent to the front portion of the body. The platform is positioned between the sole plate and the lower portion of the body and is adjustable, such as frontwardly and rearwardly, to plural positions along the lower portion of the body to change a pivot angle between the sole plate and the body.

The lower surface of the sole can have a large contact area with the ground such that it functions well on spongy or uneven playing surfaces. In some embodiments, the sole plate comprises a substantially cylindrical lower surface that is curved in a generally heel-toe direction, which can provide a substantially constant face angle over a range of different lie angles.

In some embodiments, the platform is adjustable along a continuous, non-discrete range of positions along the lower portion of the body. For example, the platform can comprise a sloped lower engagement surface that engages an upper surface of the sole plate to set the pivot angle between the sole plate and the body. The sloped lower engagement surface of the platform can vary in the distance it extends below the lower portion of the body, with a forward portion of the lower engagement surface extending a smaller distance below the lower portion of the body relative to a rearward portion of the lower engagement surface.

In some embodiments, the club head further comprises a drive screw threadably engaged with the sloped platform. The drive screw can be configured to move the platform forwardly and rearwardly along a continuous, non-discrete range of positions relative to the body when the drive screw is rotated. The drive screw can be supported by the body, such as with a collar or bushing at the rear of the body, such that the body restricts the drive screw from moving in axial and/or lateral directions relative to the body.

In some embodiments, the platform is adjustable to a plurality of discrete different positions relative the body, each position corresponding to a different pivot angle between the sole plate and the body. For example, the platform can comprise a plurality of steps or discrete surfaces that project different distances below the lower portion of the body. When the platform is positioned at each of the plurality of discrete different positions relative the body, a different one of the plurality of steps can be engaged with an upper surface of the sole plate.

In some embodiments, the stepped platform can comprise one or more upper engagement features, the lower portion of the body can comprise a plurality of registration features, and the engagement features of the platform are engagable with a different one or more of the plurality of registration features on the lower surface of the body to adjust the platform to each of the plurality of discrete different positions relative the body.

In some embodiments, the sole plate is securable to the lower portion of the body at plural different pivot angles relative to the body via a releasable fastener extending through the sole plate and into the body.

The foregoing and other objects, features, and advantages of the disclosed technology will become more apparent from the following detailed description, which proceeds with reference to the accompanying figures.

BRIEF DESCRIPTION OF THE DRAWINGS

FIG. 30 is a table listing face angle variations for plural different adjustable golf club heads.

DETAILED DESCRIPTION

Figure 1:
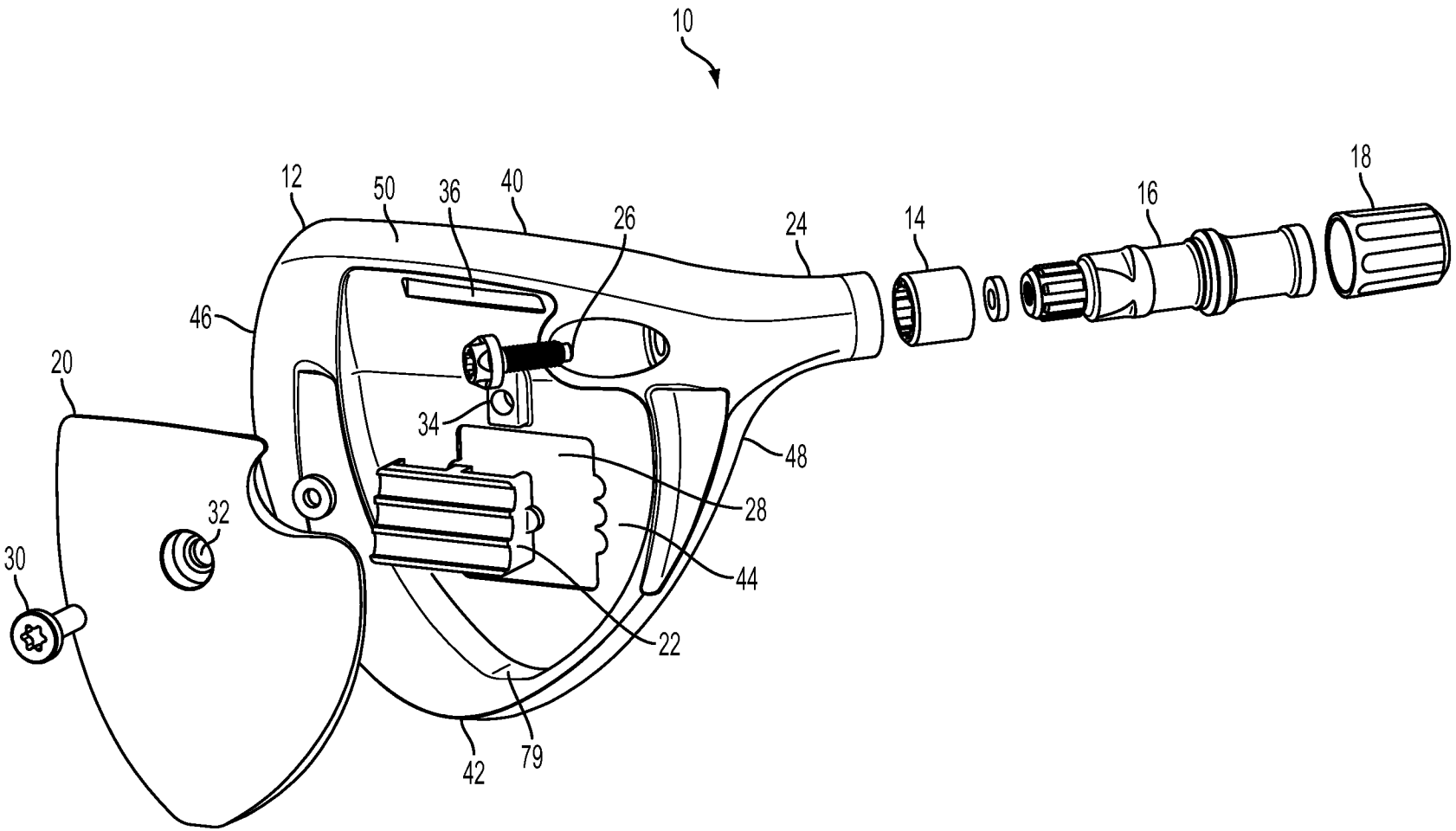
FIG. 1 is an exploded perspective view of an exemplary embodiment of a golf club head having an adjustable sole.

Described herein are embodiments of golf club heads having an adjustable sole. An adjustable sole can allow for face angle adjustments, and in some embodiments can allow the club head to maintain a substantially constant face angle over a range of different lie angles. In addition to an adjustable sole, golf clubs described herein can further comprise other adjustable parts, such as an adjustable shaft-hosel connection and/or adjustable weights. While the particular embodiments shown in the drawings comprise fairway woods, the disclosed adjustable sole technology can be used with any wood-type golf club head, including but not limited to drivers, fairways, and rescues.

FIG. 1 shows an exploded view of an exemplary embodiment of club head 10 having an adjustable sole. The club head 10 comprises a body 12, a sole plate 20, and a platform 22. As shown in FIGS. 3-6, the body 12 comprises a hosel 24, front striking plate 40, a rear end 42, a toe side 46, a heel side 48, a crown 42, and a lower portion 44. The lower portion 44 of the body is configured to receive the platform 22 and sole plate 20 in an adjustable manner.

Figure 2:
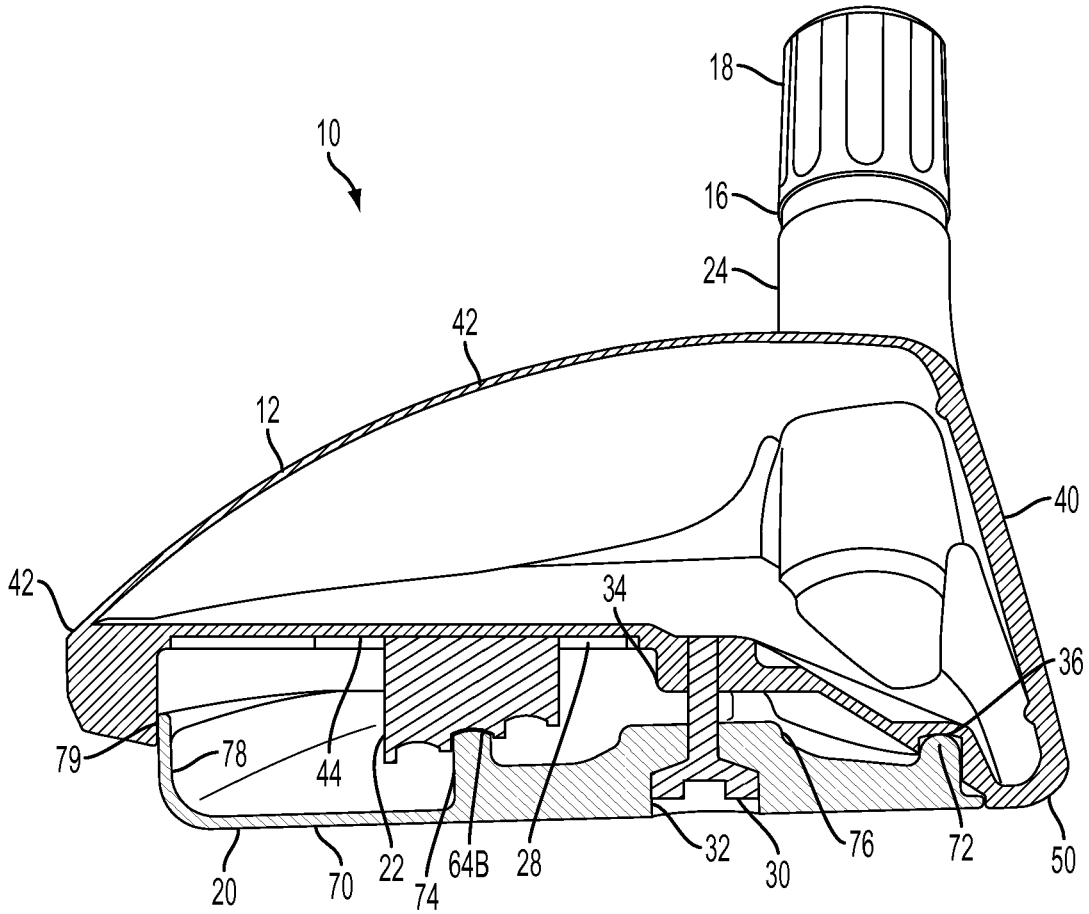
FIG. 2 is a cross-sectional view of a heelward portion of the assembled golf club head of FIG. 1, looking from the toe side.
Figure 4:
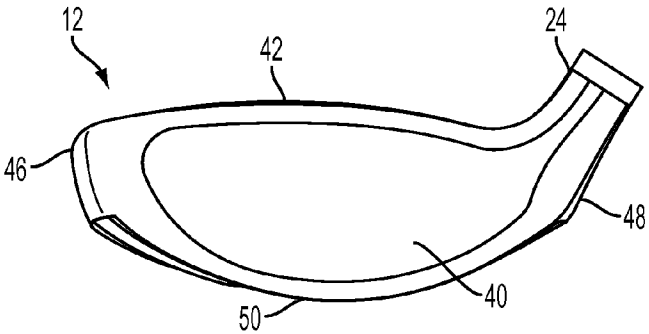
FIG. 4 is a front view of the body of FIG. 1.
Figure 6:
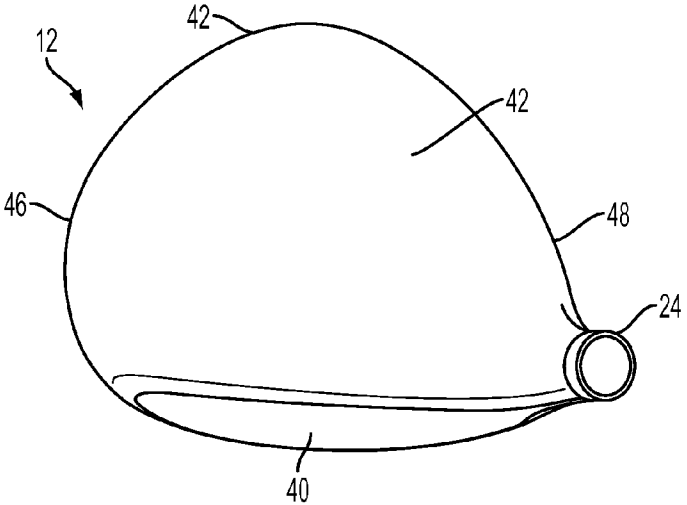
FIG. 6 is a top plan view of the body of FIG. 1.
Figure 3:
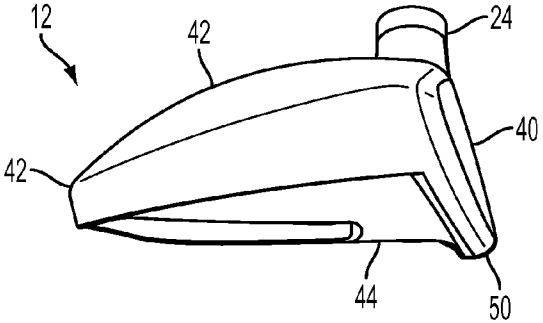
FIG. 3 is a toe end view of the body of the golf club head of FIG. 1.
Figure 5:
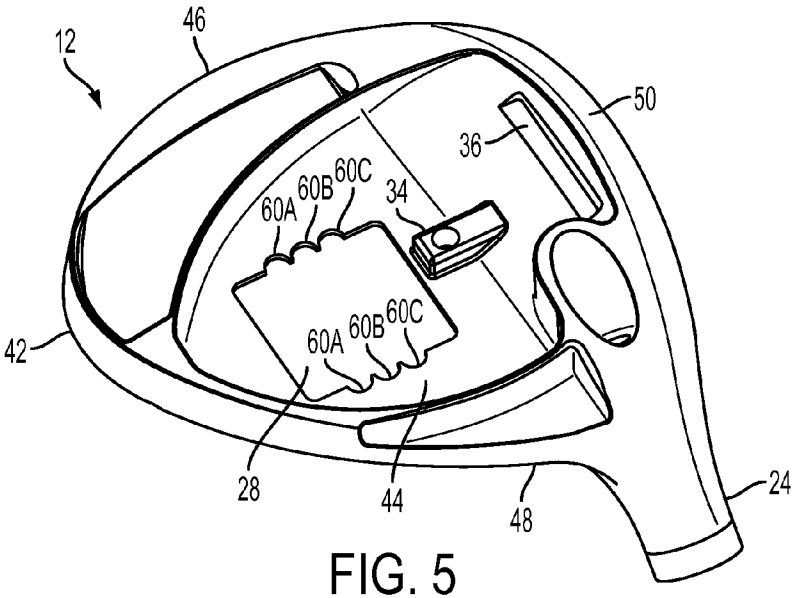
FIG. 5 is a perspective bottom view of the body of FIG. 1.
Figure 7:
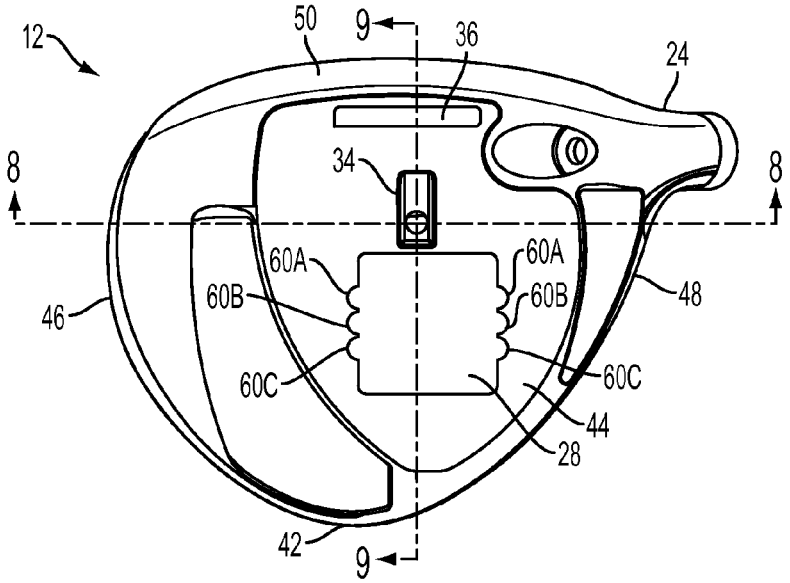
FIG. 7 is a bottom plan view of the body of FIG. 1.
Figure 8:
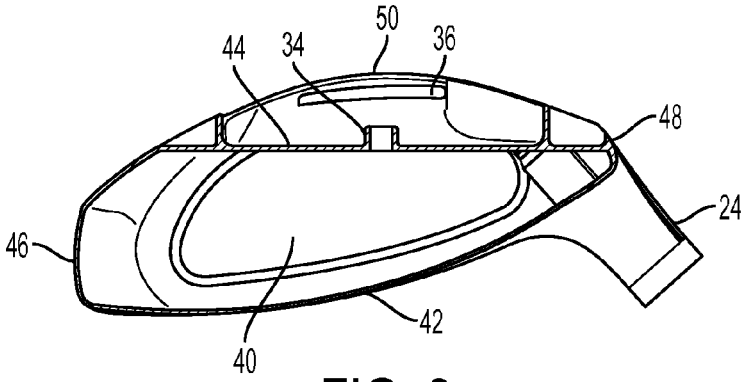
FIG. 8 is a cross-sectional view of the body of FIG. 1, taken along section line 8-8 of FIG. 7.
Figure 9:
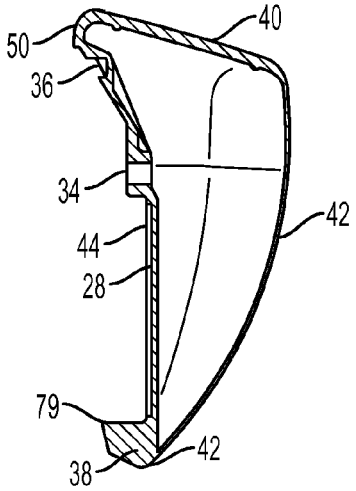
FIG. 9 is a cross-sectional view of the body of FIG. 1, taken along section line 9-9 of FIG. 7.
Figure 11:
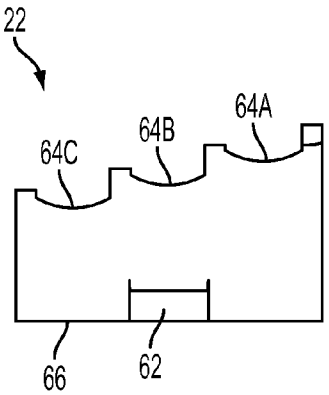
FIG. 11 is a side view of the platform of FIG. 10.
Figure 13:
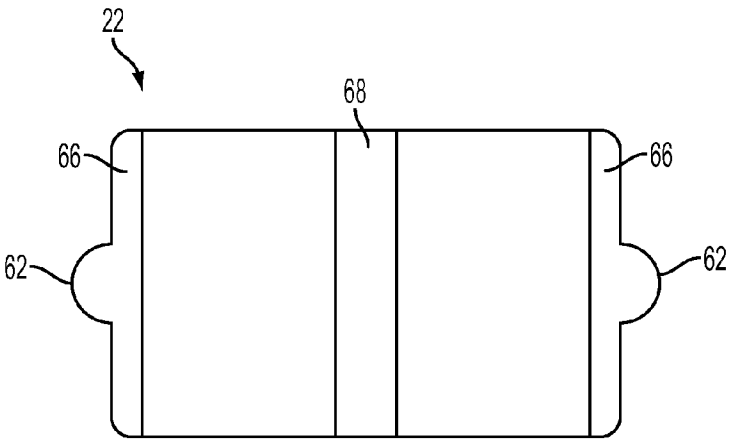
FIG. 13 is a bottom view of the platform of FIG. 10.
Figure 10:
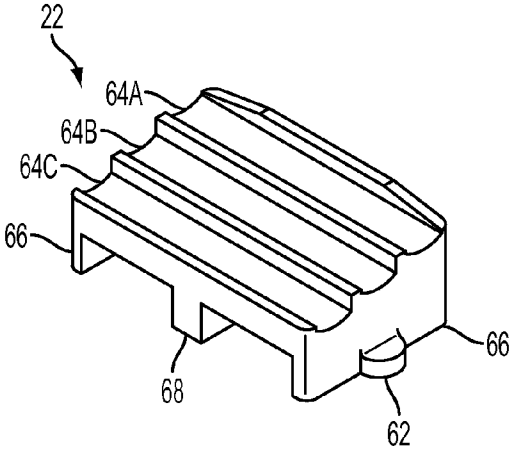
FIG. 10 is a perspective view of an exemplary stepped platform of the golf club head of FIG. 1.
Figure 12:
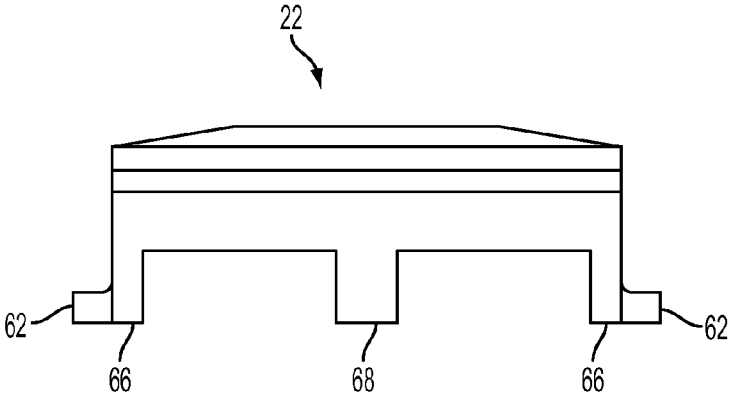
FIG. 12 is a front view of the platform of FIG. 10.
Figure 14:
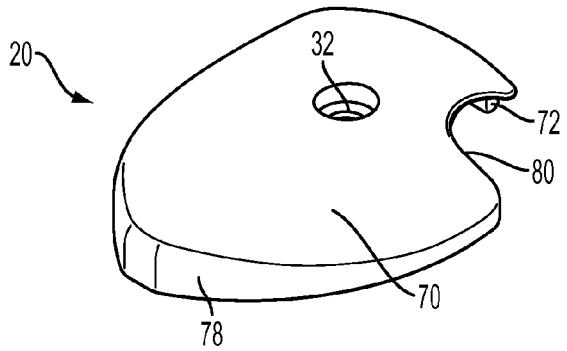
FIG. 14 is a bottom perspective view of an exemplary sole plate of the golf club head of FIG. 1.
Figure 15:
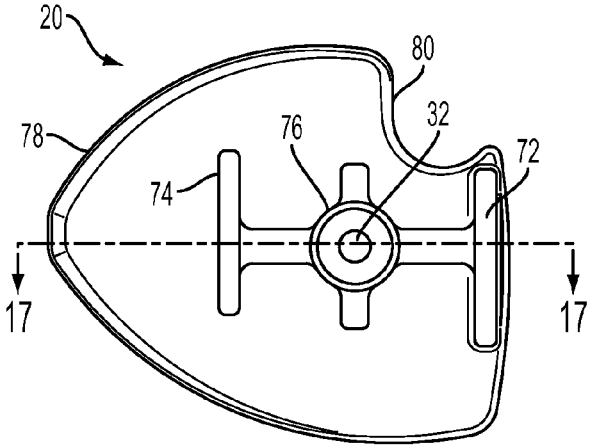
FIG. 15 is a top plan view of the sole plate of FIG. 14.
Figure 16:
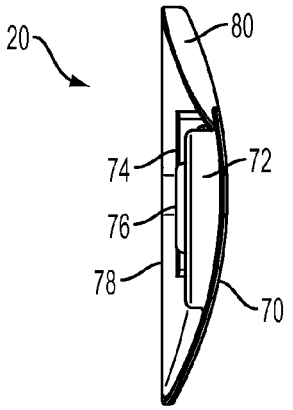
FIG. 16 is a front end view of the sole plate of FIG. 14.
Figure 17:
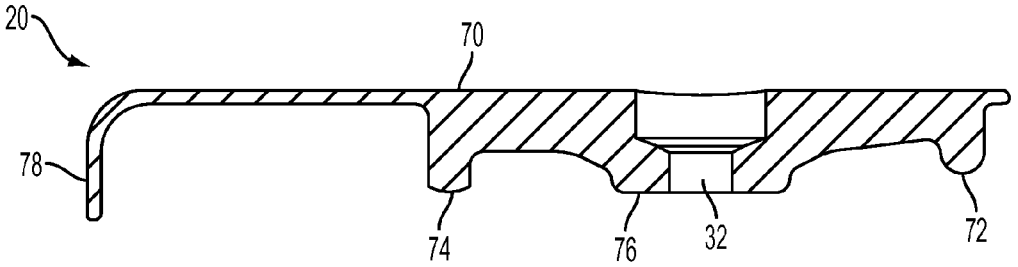
FIG. 17 is a cross-sectional view of the sole plate of FIG. 14, taken along section line 17-17 of FIG. 15.

The club head 10 can further comprise an adjustable shaft-hosel connection, such as comprising a hosel insert 14, a rotationally adjustable sleeve 16, a ferrule 18, and fastener 26, as shown in FIGS. 1 and 2. The adjustable shaft-hosel connection can be configured to couple a shaft to the club head 10 in a plurality of different orientations that provide adjustability to the face angle, loft angle, and/or lie angle of the club, as described in U.S. patent application Ser. No. 13/686,677, filed Nov. 27, 2012, which is incorporated by reference herein in its entirety.

The configuration and adjustability of the platform and sole plate can vary in different embodiments. The platform 22 is but one example, which comprises a plurality of discrete lower surfaces and is configured to be positioned on the lower portion 44 of the body 12 in a corresponding number of positions, in order to adjust the sole plate 20 to a corresponding number of different positions relative to the sole. Other platform embodiments, such as the ramped or sloped platform 102 shown in FIG. 19, can be configured to be continually adjustable along a range of non-discrete positions on the lower portion 44 of the body and can adjust the sole plate to a continuous range of positions relative to the body 12, as described below. Various embodiments of sole plates are also described that can be used with different types of platforms.

The sole plate (such as the sole plate 20 shown in FIGS. 14-17) can be pivotably adjustable relative to the body 12 in various manners and about various pivot axes. In the embodiment of FIG. 2, the sole plate 20 can have a front pivot portion 72 that engages with a corresponding recess 36 in the body 12 adjacent the front of the body. The front pivot portion 72 and/or the recess 36 can have a rounded engagement surface, for example. The front-rear position of the platform 22 relative to the body 12 can determine a pivot angle of the sole plate 20 relative to the body 12 about the pivot engagement. The pivot angle of the sole plate relative to the body can be defined as an angle between a plane tangent to given surface of the sole plate relative to a plane tangent to a given surface of the body about a heel-toe axis, wherein the two planes are parallel with the axis of pivoting between the sole and the body. The change in pivot angle can be defined as difference between the pivot angle when the sole plate is in one position relative to the sole compared to the pivot angle when the sole plate is in a second position relative to the sole. For example the pivot angle can be defined as an angle between a first plane tangent to the recessed surface 28 of the body and a second plane tangent to the lower apex of the lower surface 70 of the sole plate (see FIG. 2). For another example, the pivot angle can be defined as an angle between a first plane tangent to the striking face 40 of the club head and a second plane tangent to the lower apex of the lower surface 70 of the sole plate. Regardless of which two planes are used to define the pivot angle at a given position of the sole plate relative to the body, the change in the pivot angle between a first position of the sole plate and a second position of the sole plate can have the same value.

The lower surface 70 of the sole plate 20 can form the main contact surface of the club head 10 with the ground, though portions of the body 12, such as the bottom-front surface 50 of the body, may also contact the ground in some embodiments. In some embodiments, the lower surface 70 of the sole plate 20 can have an area that is at least about 40%, at least about 50%, at least about 60%, at least about 70%, at least about 80%, and/or at least about 90% of the total area of the club head that is configured to contact the ground. As the main contact surface with the ground, the lower surface 70 of the sole plate 20 can determine or affect the orientation of the club head 10 when the club head is resting on the ground, such as in the address position, and when the club head contacts the ground during the downswing. For example, adjusting the pivot angle of the sole plate 20 relative to the body 12 can affect the face angle and/or loft angle of the club head 10.

Because the lower surface 70 of the sole plate has a large surface area in contact with the ground, the sole plate can function well on soft and/or uneven surfaces, such as on a fairway, in the rough, or in spongy or soft conditions. The large contact area of the sole plate with the ground can resist sinking into soft turf. Further, small variations in the contours of the ground, such as in the rough, can have less effect on the orientation of club head as it rests on the ground or as it contacts the ground during a swing. On soft or spongy turf, the lower surface 70 of the sole plate can contact the ground along an area extending from the front to the rear of the lower surface, and over at least a portion of the heel-toe curvature of the lower surface. This contact area can be larger and more effective on soft or uneven surfaces compared to other adjustable sole club heads that rely on a small area of contact at the front of the sole and another small area of contact at an adjustable rear portion of the sole.

The lower surface 70 of the sole plate 20 can have a convex curvature generally in the heel-toe direction such that the face angle of the club head can be maintained substantially constant when the club head 10 is positioned at a range of different lie angles. The heel-toe curvature of the lower surface 70 can have a substantially constant radius of curvature. In some embodiments, the lower surface 70 can have a substantially cylindrical shape, with little or no curvature in the front-rear direction and a substantially constant curvature in the heel-toe direction. The radius of curvature in the heel-toe direction can be about 62.5 mm, less than 62.5 mm, or greater than 62.5 mm. These exemplary radius of curvature values can be constant values over substantially the whole lower surface 70, or can be average radius of curvature values over substantially all or a portion of the lower surface 70.

The lower portion 44 of the body 12 can be configured to receive the platform 22 is a plurality of different positions. As shown in FIGS. 5 and 7-9, the lower portion 44 of the body 12 can comprise a recessed portion 28 that comprises a plurality of pairs of registration features 60A-60C. In the illustrated example, the recessed portion 28 is configured to receive the platform 22 in three different positions. As shown in FIG. 1 and FIGS. 10-13, the platform 22 comprises two laterally extending tabs 62 that are configured to engage with any one of the pairs of registration features 60A-60C in the recessed portion 28 of the body. In a rearward-most position, the platform 22 can be positioned such that the tabs 62 are engaged with the registration features 60A; in a middle position, the platform 22 can be positioned such that the tabs 62 are engaged with the registration features 60B; and in a forward-most position, the platform 22 can be positioned such that the tabs 62 are engaged with the registration features 60C. In other embodiments, the recessed portion 28 can comprise any number of pairs of registration features to provide a different number of platform positions. In some embodiments, the recessed portion 28 can comprise a plurality of single registration features, such as on one side of the recessed portion, instead of pairs of registration features. Similarly, the platform 22 can comprise only a single tab 62 in some embodiments. Other configurations of the lower portion 44 of the body and/or of the platform 22 can be included in some embodiments in order to provide a plurality of discrete, predefined positions for the platform to be engaged with the body.

Once the platform 22 is positioned in one of the available discrete, predefined positions on the lower surface 44 of the body, the sole plate 20 can be secured to the body 12 such that an upper surface of the sole plate engages with one of the engagement surface, or steps, 64 of the platform 22. The engagement of the sole plate 20 with the platform 22, along with the registration features 60A-C and other surfaces of the recessed portion 28, can hold the platform in place against the body 12 such that the platform is restricted from moving relative to the body or the sole plate. With the front pivot portion 72 of the sole plate engaged in the recess 36 in the lower portion 44 of the body, the sole plate 20 can be secured to the body 12 with a fastener 30 that passes through an opening 32 in the sole plate and threadably engages with a threaded portion 34 of the lower portion 44 of the body (FIG. 2). To adjust the pivot angle of the sole plate 20 relative to the body 12, the fastener 30 can be loosened and/or removed to allow the sole plate to disengage from the platform 22. The platform 22 can then be manually moved to a different position, such as by moving the platform so that the tabs 62 engage with a different pair of the registration features 60A-C, and the sole plate can be re-secured by tightening the fastener 30.

As shown in FIGS. 10-13, the platform 22 can comprise a plurality of lower engagement surfaces, such as lower engagement surfaces 64A-C, that are configured to be selectively engaged with an upper portion of the sole plate 20 to set the pivot angle of the sole plate. In some embodiments, the number of lower engagement surfaces can be at least two, at least three, at least four, at least five, at least six, at least seven or more than seven. The front-rear dimensions of the lower engagement surfaces can be selected in part based on the total number of lower engagement surfaces present and/or on the available front-rear space present between the sole plate and the body. The lower engagement surfaces can be rounded, as illustrated, flat, sloped, or have other contours. The platform 22 can further comprise an upper engagement portion configured to engage with the lower portion 44 of the body. In some embodiments, the upper engagement portion can comprise a pair of lateral walls 66 and a central ridge 68, as shown in FIGS. 10-13. In other embodiments, the upper engagement portion can comprise a flat upper surface that extends across the whole upper side of the platform 22. The upper engagement portion can include the lateral tab or tabs 62. Each of the lower engagement surfaces 64A-C extends a different height below the upper engagement surface of the platform when the platform is secured on the club head between the sole plate and the body. The lower engagement surface 64A extends the largest distance, while the lower engagement surface 64C extends the smallest distance.

As shown in FIGS. 2 and 15-17, the sole plate 20 can comprise an upwardly extending ridge 74 that is configured to contact a selected one of the lower engagement surfaces 64A-C when the sole plate is secured to the body. When the platform 22 is positioned at each of the plurality of discrete different positions relative the body 12, a different one of the plurality of lower engagement surfaces of the platform is engaged with the ridge 74 of the sole plate. For example, when the tabs 62 of the platform 22 are engaged with the registration features 60A on the lower portion of the body, the lower engagement surface 64A of the platform is in contact with the ridge 74 of the sole plate; when the tabs 62 are engaged with the registration features 60B, the lower engagement surface 64B is in contact with the ridge 74; and when the tabs 62 are engaged with the registration features 60C, the lower engagement surface 64C is in contact with the ridge 74.

The sole plate 20 can further comprise a raised annular portion 76 around the opening 32, a cutout portion 80 configured to provide access for the fastener 26 to be inserted and removed from the lower end of the hosel 24 (see FIG. 1), and a rim 78 that extends upwardly from the perimeter of the lower surface 70 around lateral and rear sides of the sole plate.

When the sole plate 20 is secured to the body 12, the pivot angle of the sole plate relative to the body can be defined by the contact between the front pivot portion 72 with the recess 36 in the body and the contact between the ridge 74 with one of the lower engagement surfaces 64A-C of the platform. When the ridge 74 is engaged with a relatively shorter lower engagement surface, such as the lower engagement surface 64C, the rim 78 of the sole plate 20 is closer to the lower portion 44 of the body forming a smaller pivot angle relative to the body; and when the ridge 74 is engaged with a relatively taller lower engagement surface, such as the lower engagement surface 64A, the rim 78 of the sole plate 20 is farther from the lower portion 44 of the body forming a larger pivot angle relative to the body.

With reference to FIG. 2, the height of the rim 78 can be selected such that an upper edge of the rim remains spaced from the lower portion 44 of the body when the sole plate 20 is in the position providing the smallest pivot angle relative to the body, and/or such that the upper edge of the rim 78 has an elevation about equal to or greater than an elevation of a lower edge of a wall 79 extending around the lower portion 44 of the body when the sole plate 20 is in the position providing the largest pivot angle relative to the body. The sole plate 20 can be configured such that the rim 78 provides a close fit with the wall 79 of the body around the perimeter of the sole plate in order to restrict water, dirt, or other materials from entering the open cavity between the sole plate and the body. In some embodiments, a gasket or other sealing member can be provided between the rim 78 and the wall 79.

Figure 18:
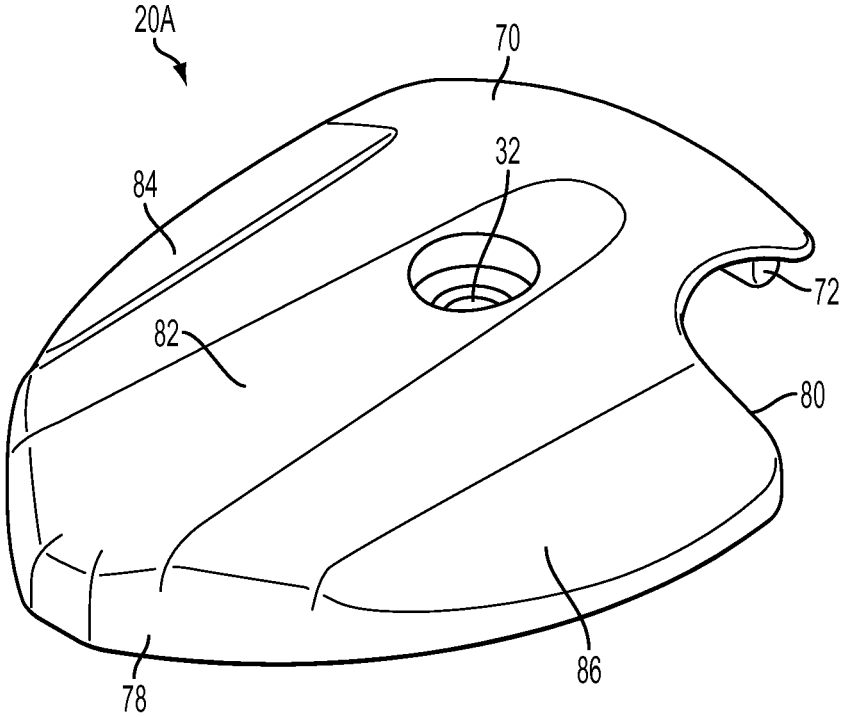
FIG. 18 is a bottom perspective view of another exemplary sole plate for the golf club head of FIG. 1.

FIG. 18 shows an alternative embodiment of a sole plate 20A that comprises a contoured lower surface. The lower surface of the sole plate 20A can comprise one more of the illustrated recessed surfaces 82, 84, and/or 86, in addition to generally cylindrical surface 70. The surface 70 is configured to contact the ground, while the recessed surfaces can be slightly elevated from the ground and/or can contact the ground on uneven or rough surfaces. The recessed surfaces 82, 84, and/or 86 can comprise concave surfaces. The recessed surfaces 82, 84, 86 can provide reduced overall interaction of the sole plate 20 with the ground, grass, sand, and other objects. For example, on a relative flat, smooth surface, such as a fairway, the recessed surfaces 82, 84, and 86 reduce the total surface area of the lower surface of the sole plate 20A, providing reduces resistance to and less interruption of the swinging motion of the club head as it contacts and/or slides along the ground surface. With uneven, soft, or rough surfaces, the recessed surfaces 82, 84, 86 can allow the club head to move through the surface material, such as through thick rough, sand, or mud, with less resistance and less interruption of the swinging motion. The upper surfaces, rim, and adjustability of the sole plate 20A can be similar to that of the sole plate 20.

Figure 19:
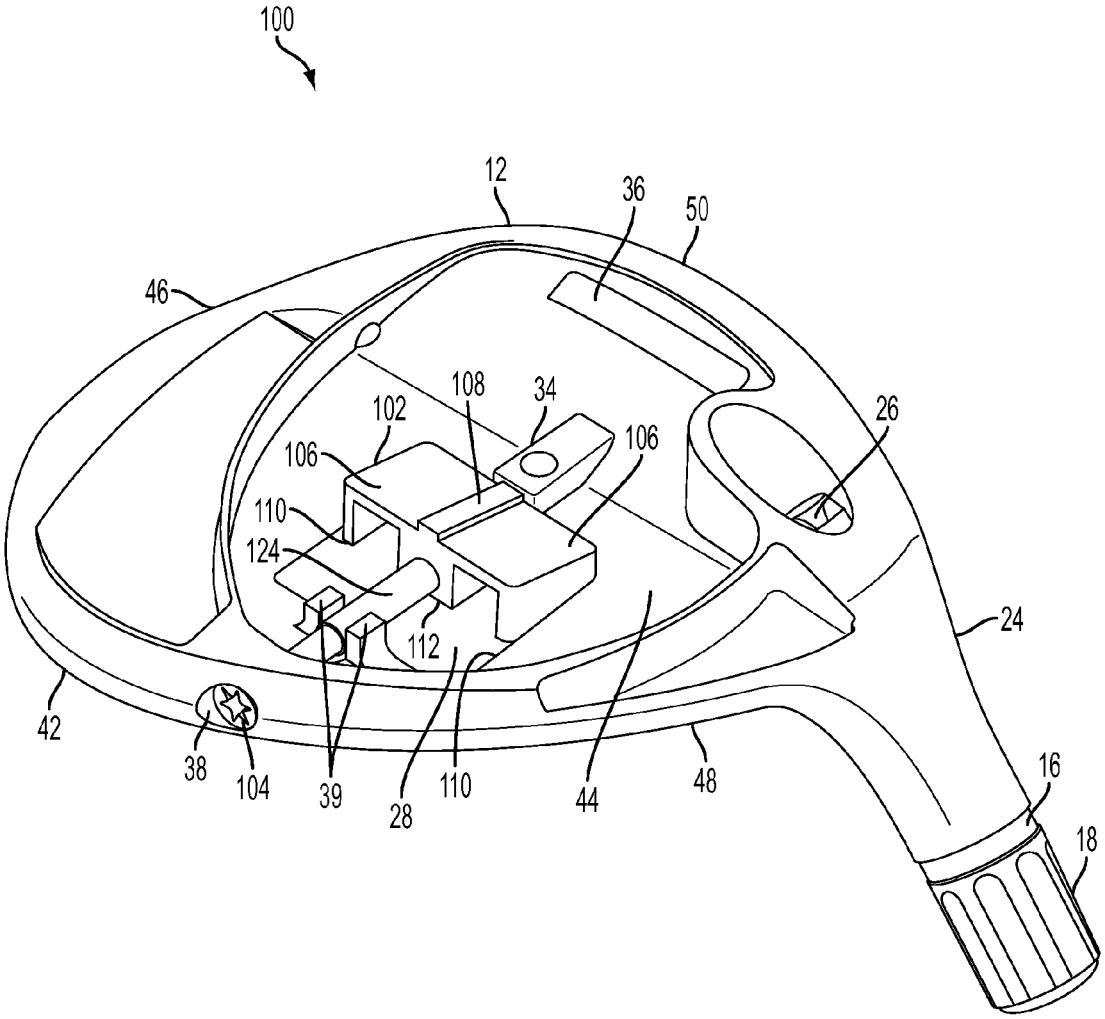
FIG. 19 is a bottom perspective view of another exemplary golf club head having an adjustable sole, with the sole plate removed.
Figure 20:
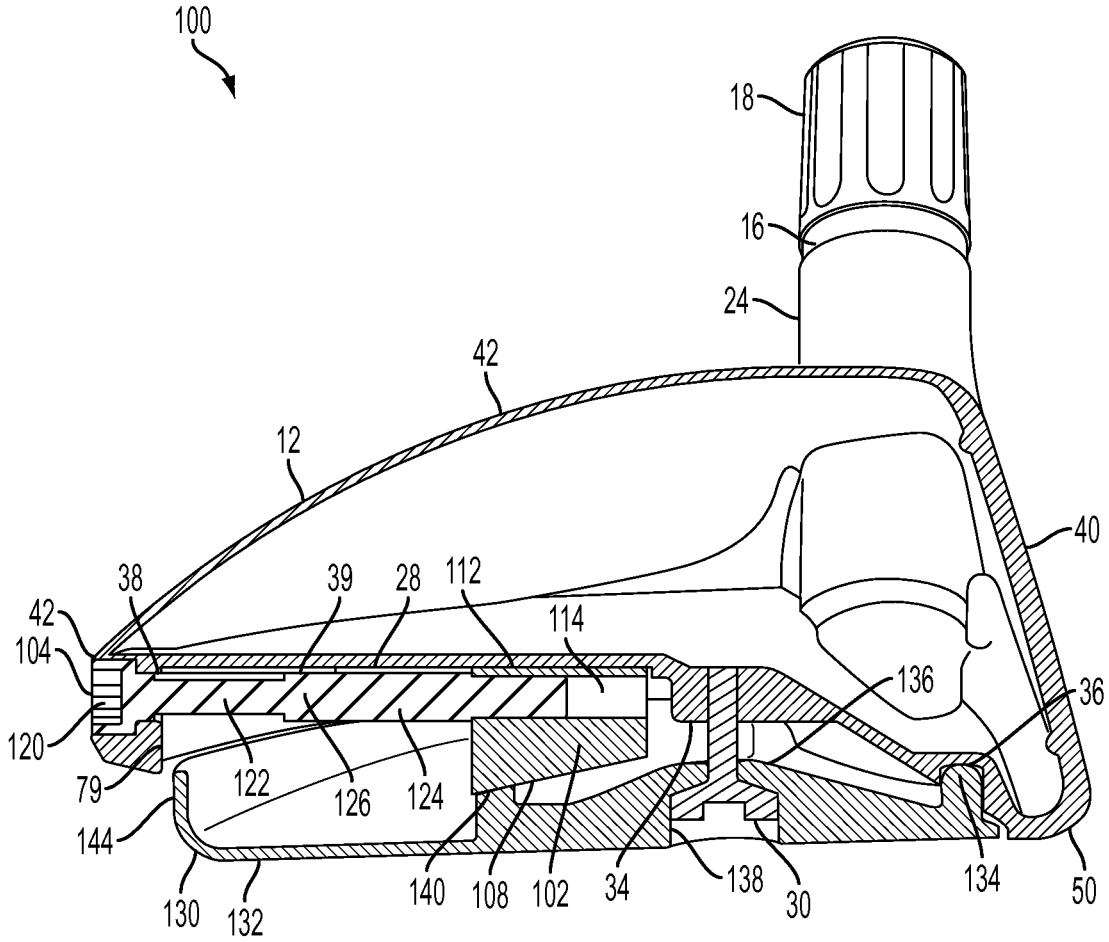
FIG. 20 is a cross-sectional view of a heelward portion of the golf club head of FIG. 19, including a sole plate, looking from the toe side.
Figure 21:
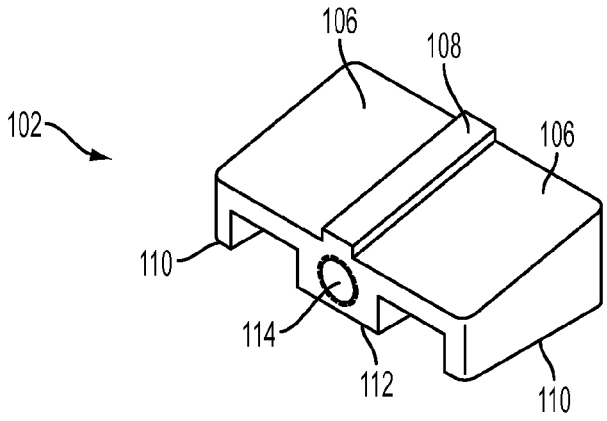
FIG. 21 is a perspective view of an exemplary ramped platform of the club head of FIG. 19.
Figure 22:
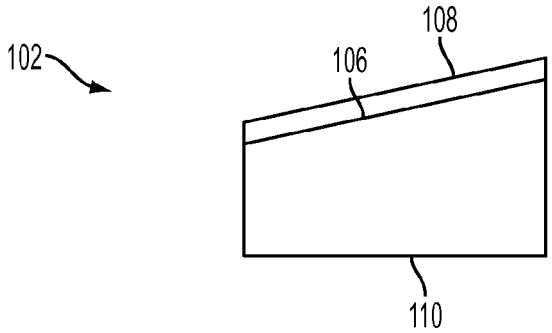
FIG. 22 is a side end view of the platform of FIG. 21.
Figure 23:
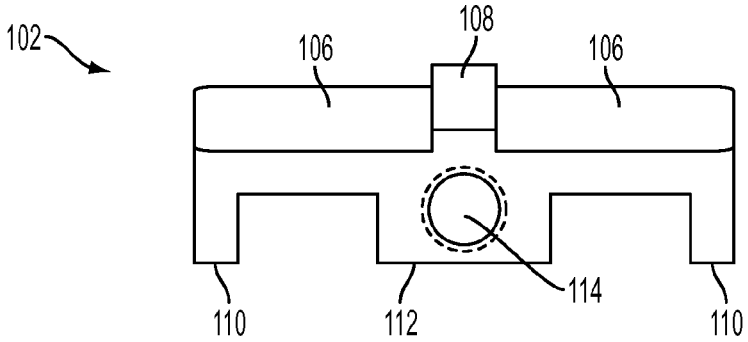
FIG. 23 is a front end view of the platform of FIG. 21.
Figure 24:
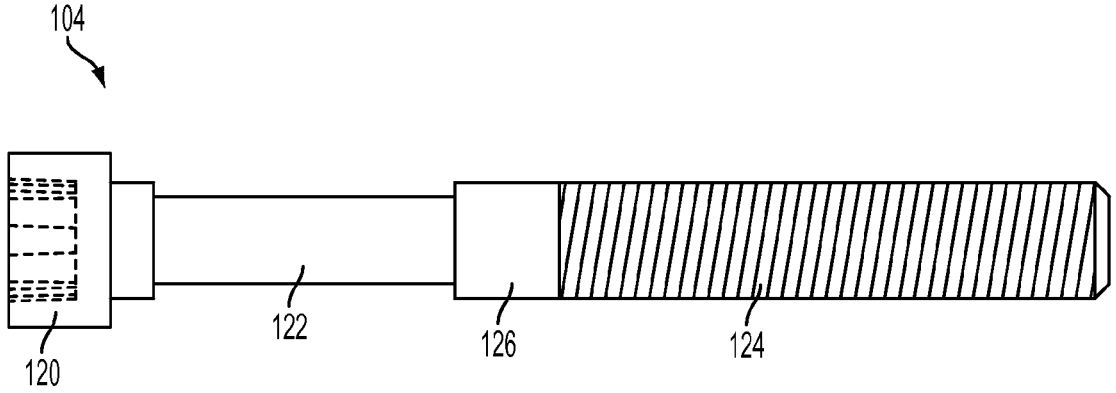
FIG. 24 is a side view of an exemplary drive screw of the club head of FIG. 19.
Figure 25:
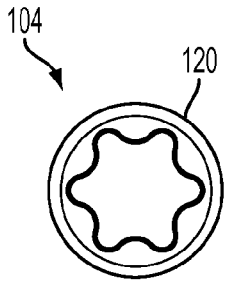
FIG. 25 is an end view of the drive screw of FIG. 24.
Figure 26:
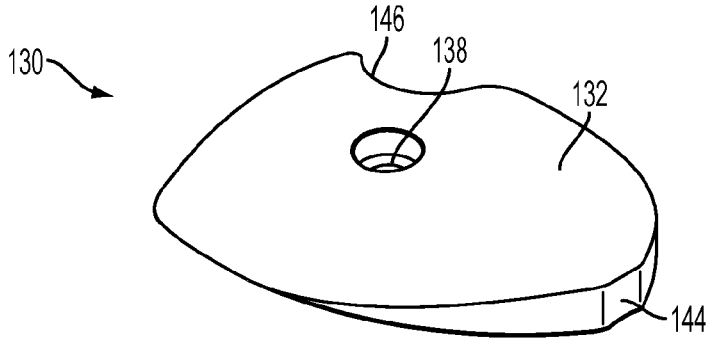
FIG. 26 is a bottom perspective view of an exemplary sole plate of the club head of FIG. 19.
Figure 27:
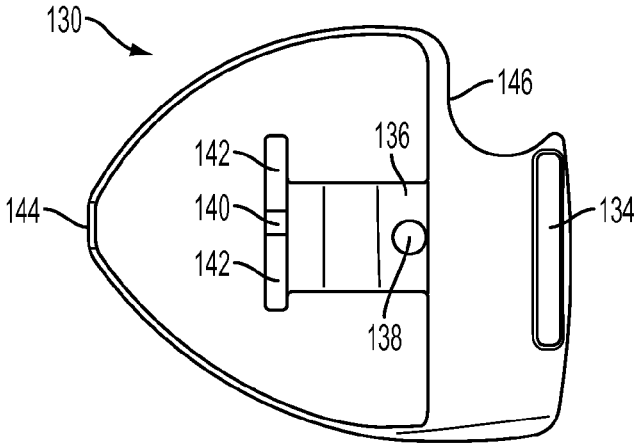
FIG. 27 is a top plan view of the sole plate of FIG. 26.
Figure 28:
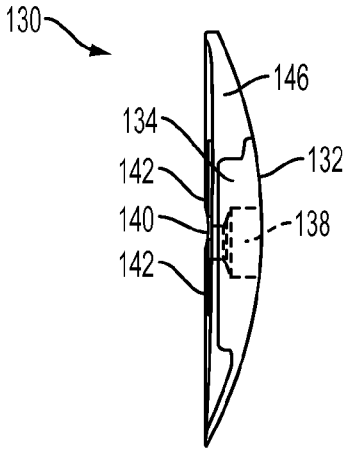
FIG. 28 is a front end view of the sole plate of FIG. 26.
Figure 29:
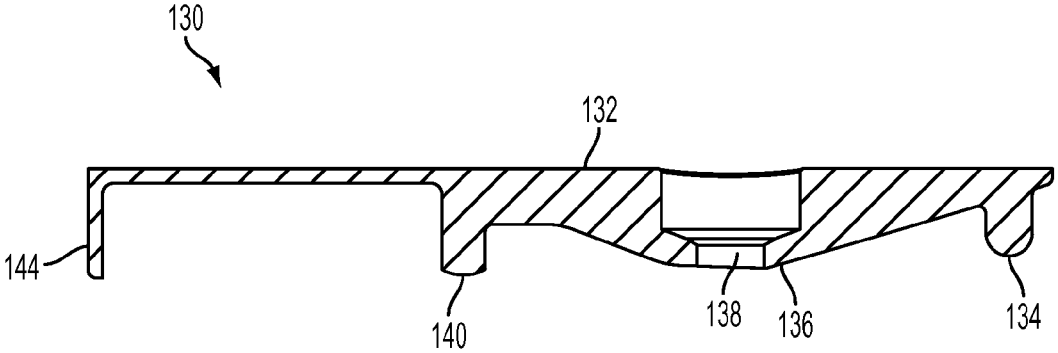
FIG. 29 is a cross-sectional view of the sole plate of FIG. 26.3

FIGS. 19-29 illustrate an alternative embodiment of a club head 100 that comprises an adjustable sole. In the club head embodiment 100, the stepped platform 20 is replaced with a sloped or ramped platform 102, as shown in FIGS. 21-23. The sloped platform 102 can be adjusted in the front-rear directions over a continuous, non-discrete range of position, allowing the sole plate 130 (see FIGS. 26-29) to be adjusted to over a continuous range of pivot angles relative to the body. The sloped platform 102 can be adjusted in the front-rear directions by turning a drive screw 104, as shown in FIGS. 24-25.

As shown in FIG. 19, the recessed portion 28 on the bottom of the body is generally rectangular and configured to allow the platform 102 to slide forwardly and rearwardly along the bottom of the body over a certain range, while restricting the platform from moving toewardly or heelwardly. The lower portion 44 of the body can further comprise a pair of downwardly extending lateral braces 39 (see FIG. 19) that bracket the drive screw 104 on either side of smooth bearing portion 126 of the drive screw. The braces 39 restrict lateral movement of the drive screw 104. In the club head 100, the body 12 further comprises a hole 38 extending rearwardly through the wall 79 to further support the drive screw 104 and provide another bearing surface that allows the drive screw to rotate but acts as a collar to restrict lateral motion of the drive screw relative to the body. The hole 38 can also have a rear surface that abuts the head 120 of the drive screw and restricts the head of the drive screw from moving axially forward through the hole 38. A head 120 of the drive screw 104 is accessible from the rear end 42 of the club head 100 and can be rotated, such as with a screw driver, wrench, or other tool.

In some embodiments, a separate clip or collar (not shown) can be positioned around the necked portion 122 of the drive screw (see FIGS. 20 and 24) to restrict axial motion of the drive screw relative to the body 12. Such a clip can occupy substantially the entire axial length of the necked portion 122, having a rear end the abuts the rear wall 79 of the body to restrict rearward axial motion of the drive screw and having a front end that abuts the rear surfaces of the braces 39 and/or the bearing portion 126 of the drive screw 104 to restrict forward axial motion of the drive screw. Such a clip can have a generally cylindrical configuration with a split or slot along one side such that is sufficiently resiliently flexible to be temporarily deformed enough to snap over the necked portion 122 of the drive screw after the drive screw is positioned through the hole 38 of the body, and can comprise a polymeric or metallic material for example.

The drive screw 104 further comprises a threaded engagement portion 124 that is threadably coupled to an internally threaded opening 114 of the platform 102, or threadably coupled to an internally threaded sleeve that is fixed to the platform 102. When the sole plate 130 is secured to the body and engaged with the platform 102, the platform is prevented from rotating or translating in any direction other than forwardly or rearwardly. Thus, rotation of the drive screw 104 causes the platform 102 to translate either forwardly or rearwardly relative to the body 12 and sole plate 130.

As shown in FIG. 21, the platform 102 can comprise a primary sloped lower engagement surface 106, a sloped lower ridge 108, upper engagement surfaces 110 and 112, and/or the internally threaded opening 114. The upper engagement surfaces 110, 112 contact and slide along the recessed portion 28 of the body. The lower engagement surface 106 and ridge 108 are configured to contact an upper surface of the sole plate 130 to set the pivot angle of the sole plate relative to the body. The lower engagement surface 106 and/or the ridge 108 can be planar (i.e., constant slope) or can be curved or have a variable slope. In other embodiments, the sloped platform can comprise any configuration having a wedge-like or tapered shape with non-parallel upper and lower surfaces.

As shown in FIGS. 26-29, the sole plate 130 can comprise a lower surface, having a heel-toe curvature as described in regard to the lower surface 70 of sole plate 20, a front pivot portion 134 that pivotally engages the front recessed portion 36 of the body, a raised annular region 136 surrounding a screw hole 138, a perimeter rim 144 similar to the rim 78 of the sole plate 20, and a ridge 142 with a notch 140. The upper ridge 142 of the sole plate is configured to contact the lower engagement surface 106 of the platform 102, with the ridge 108 of the platform being positioned in the notch 140.

FIG. 20 shows a cross-sectional side view taken along the longitudinal axis of the drive screw 104 and cutting through the sloped ridge 108 of the platform 102 and the notch 140 in the sole plate 130. In the configuration shown in FIG. 20, the platform 102 is a forward-most position such that a tallest, rear-most portion of the platform 102 is in contact with the ridge 142 of the sole plate, causing the sole plate to be positioned at a maximum pivot angle relative to the body. The fastener 30 passes through the opening 138 in the sole plate and is engaged with the raised portion 34 of on the lower portion 44 of the body to secure the sole plate 130 at this position. To reduce the pivot angle of the sole plate 130, the fastener 30 can be loosened and the drive screw 104 rotated to slide the platform rearwardly along the recessed portion 28 of the body, causing the upper ridge 142 of the sole plate to be in contact with a shorter portion of the platform 102. The fastener 30 can then be tightened to secure the sole plate and platform at the new position. In this embodiment, the fastener 30 does not need to be removed from the body, but can be loosened sufficiently to allow the platform to slide to a desired new position, and then re-tightened.

Changes in the pivot angle of the sole plate relative to the body of the club head can cause corresponding changes to the face angle of the club head when the club head is in contact with the ground in the address position. As the sole plate pivots farther away from the lower portion of the body, and the pivot angle increases, the club head closes and the face angle of the club head decreases. Conversely, the face angle increases as the sole plate is at a smaller pivot angle relative to the body.

FIG. 30 is a table showing measured face angles values for five different exemplary embodiments of the club head 10 having an adjustable sole with a stepped platform in combination with an adjustable shaft-hosel connection for adjusting loft angle. The top portion of the table includes face angle data for the five club head embodiments with the adjustable shaft-hosel connection set to a neutral loft angle (e.g., 9.5 degree loft). The middle portion of the table includes face angle data for the five club head embodiments with the adjustable shaft-hosel connection set to a −1.5 degree loft angle change from the neutral position (e.g., 8 degree loft). The bottom portion of the table includes face angle data for the five club head embodiments with the adjustable shaft-hosel connection set to a +1.5 degree loft angle change from the neutral position (e.g., 11 degree loft). The "Open" face angle column includes face angles for the five club head embodiments with the sole plate set to a minimum pivot angle relative to the body; the "Closed" face angle column includes face angles for the five club head embodiments with the sole plate set to a maximum pivot angle relative to the body; and the "Neutral" face angle column includes face angles for the five club head embodiments with the sole plate set to an intermediate pivot angle relative to the body. For example, with regard to the club head embodiment 10 of FIGS. 1-17, including the stepped platform 22, the "Open" face angle column corresponds to a configuration with the shortest lower engagement surface 64C of the platform in contact with the ridge 74 of the sole plate; the "Neutral" face angle column corresponds to a setting with the middle lower engagement surface 64B of the platform in contact with the ridge 74 of the sole plate; and the "Closed" face angle column corresponds to a setting with the tallest lower engagement surface 64A of the platform in contact with the ridge 74 of the sole plate. The "Open Change" column includes the differences between the face angles listed in the "Open" column and the "Neutral" column. The "Closed Change" column includes the differences between the face angles listed in the "Closed" column and the "Neutral" column.

The values provided in the table of FIG. 30 are measured values taken from certain exemplary embodiments of the club head 10 described herein. Other embodiments can provide different face angle values at different sole plate settings. For example, in some embodiments, the overall height of the platform can be larger or smaller than those described in FIG. 30, causing corresponding changes in face angle values. In some embodiments, the club head can comprise a stepped platform having more or fewer than three steps or discrete lower engagement surfaces, providing different face angle adjustability. Similarly, the length and slope profile of the ramped platform can vary in different embodiments, providing corresponding different face angle adjustability.

Figure 31:
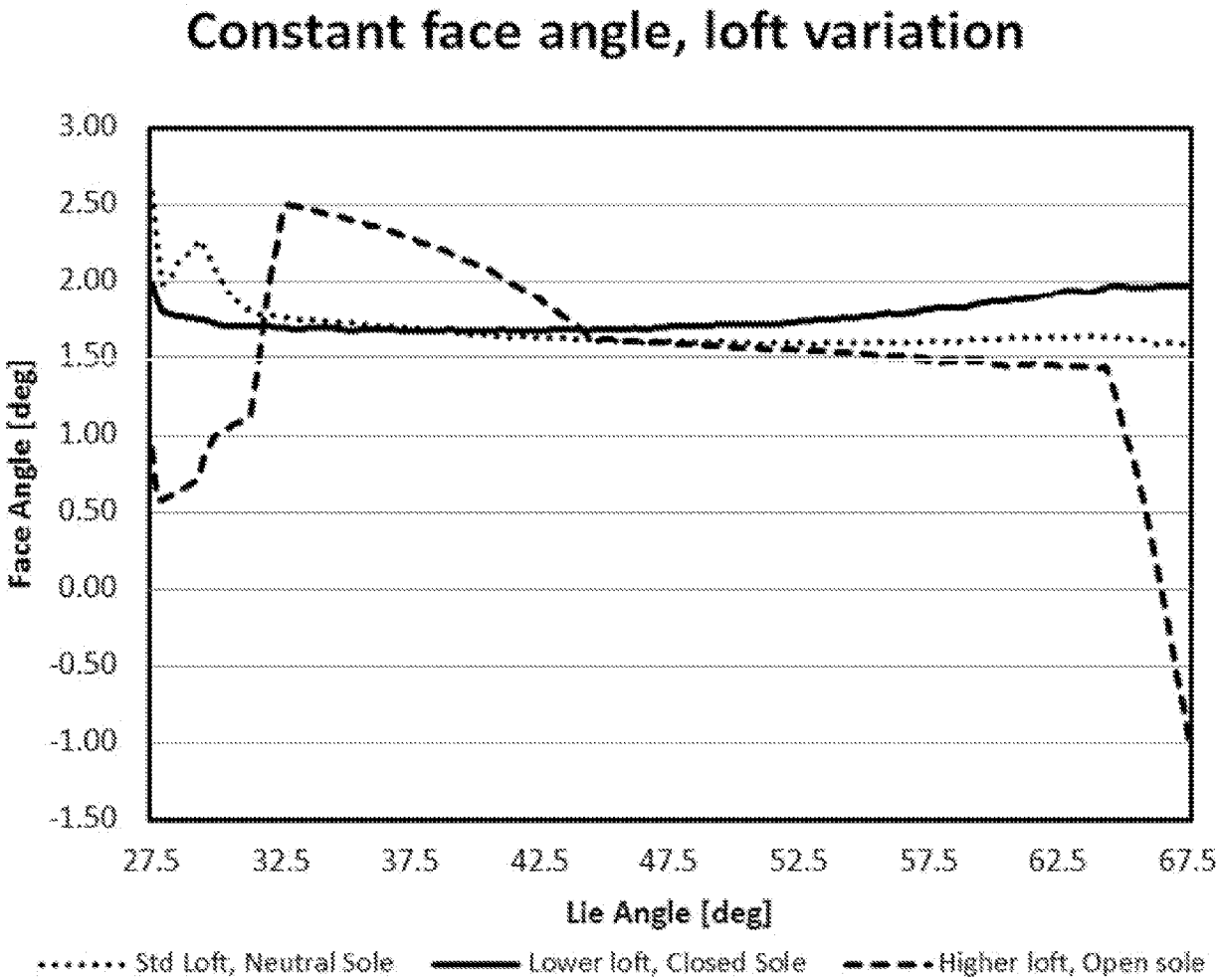
FIGS. 31-34 are graphs showing face angle as a function of lie angle for various configurations of adjustable golf club heads.

FIGS. 31-34 are graphs showing computer simulated values of face angle as a function of lie angle for various different configurations of the club head 10 described herein. FIG. 31 illustrates the variation in face angle as a function of lie angle for the club head 10 in three different adjustability configurations. The dotted line represents a configuration with the shaft-hosel connection set to a standard loft angle and the sole plate set to a neutral position (i.e., the intermediate step of the platform 22). The solid line represents a configuration with the shaft-hosel connection set to a lower loft angle and the sole plate set to a larger pivot angle/closed face angle position (i.e., the tallest step of the platform 22). The dashed line represents a configuration with the shaft-hosel connection set to a higher loft angle and the sole plate set to a smaller pivot angle/open face angle position (i.e., the shortest step of the platform 22). FIG. 31 illustrates that the adjustable sole can be used to compensate for face angle changes caused by adjusting the shaft-hosel connection to different loft angle settings. For example, when the shaft-hosel connection is adjusted to a lower loft angle, this can also cause a coincident increase, or opening, of the face angle. In order to compensate for that coincident increase of the face angle, the sole plate can be adjusted to a larger pivot angle (i.e., the tallest step of the platform 22) in order to reduce, or close, the face angle, such as near to its original value before the shaft-hosel connection was adjusted. Conversely, when the shaft-hosel connection is adjusted to a higher loft angle, this can also cause a coincident decrease of the face angle. In order to compensate for that coincident decrease of the face angle, the sole plate can be adjusted to a smaller pivot angle (i.e., the shortest step of the platform 22) in order to increase the face angle, such as near to its original value before the shaft-hosel connection was adjusted. Thus, by adjusting the sole plate, the face angle of the club head can be maintained at a substantially constant value over a range of lie angles and/or over a range of different loft angle settings of the shaft-hosel connection.

Figure 32:
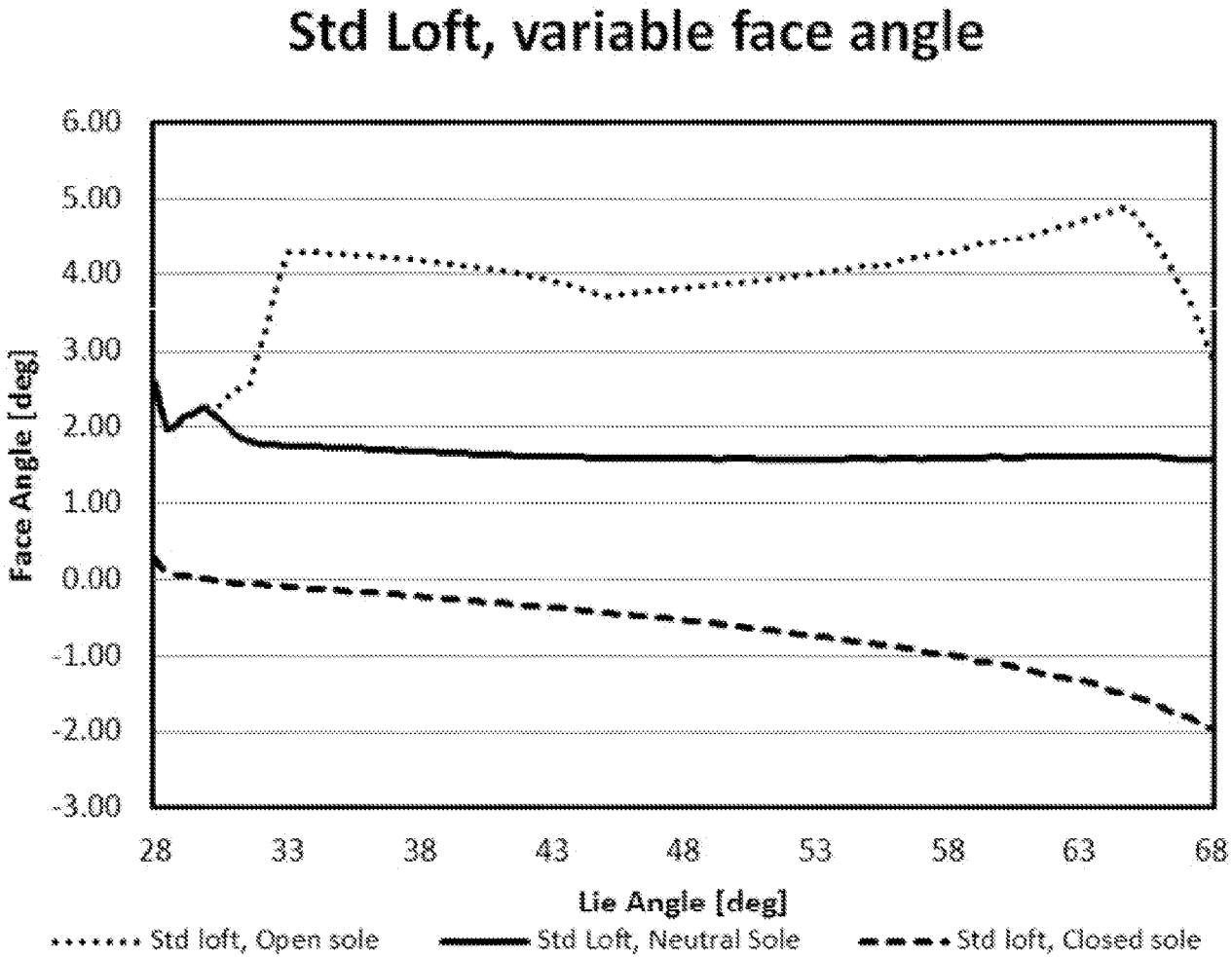
Figure 33:
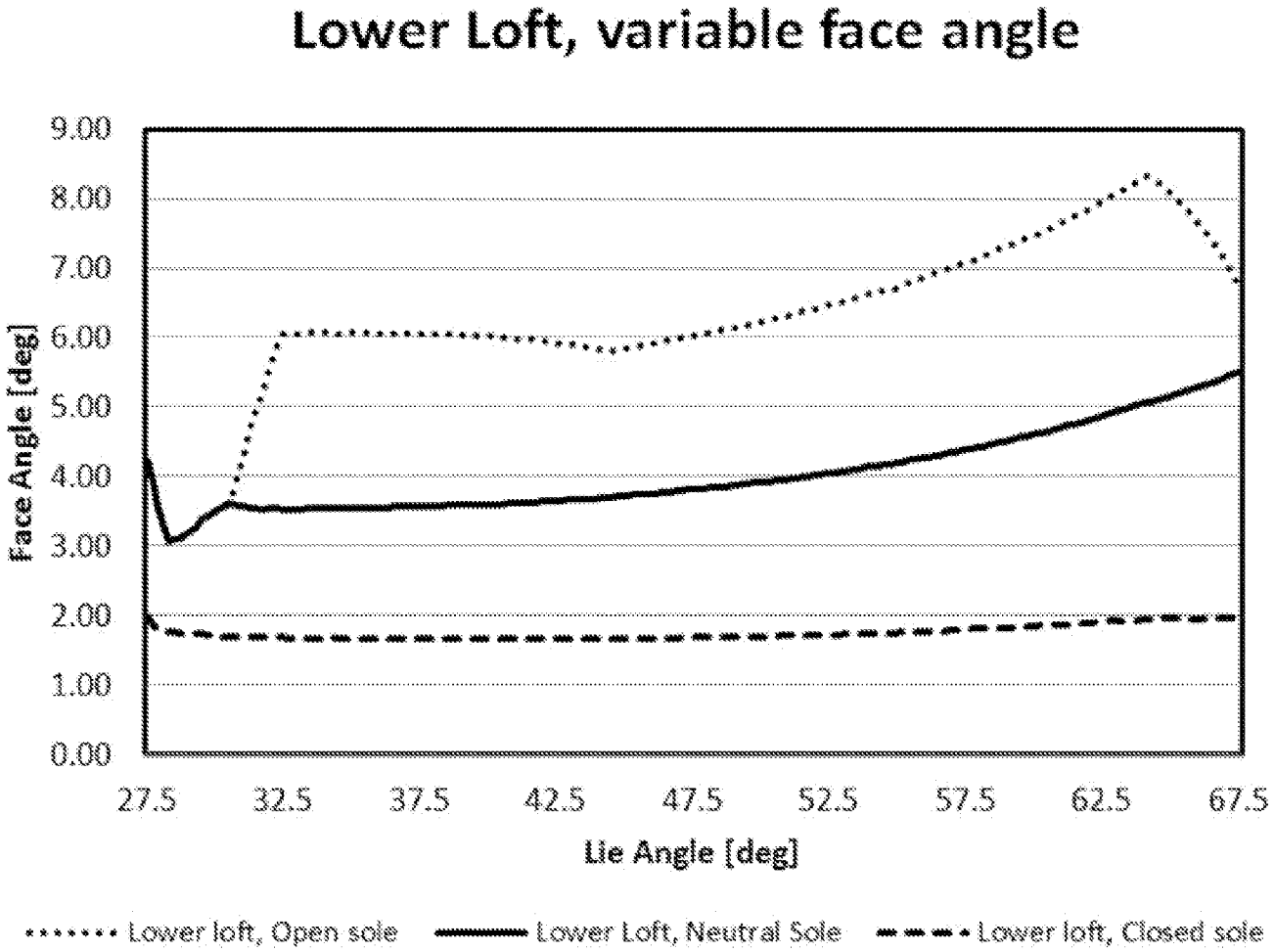
Figure 34:
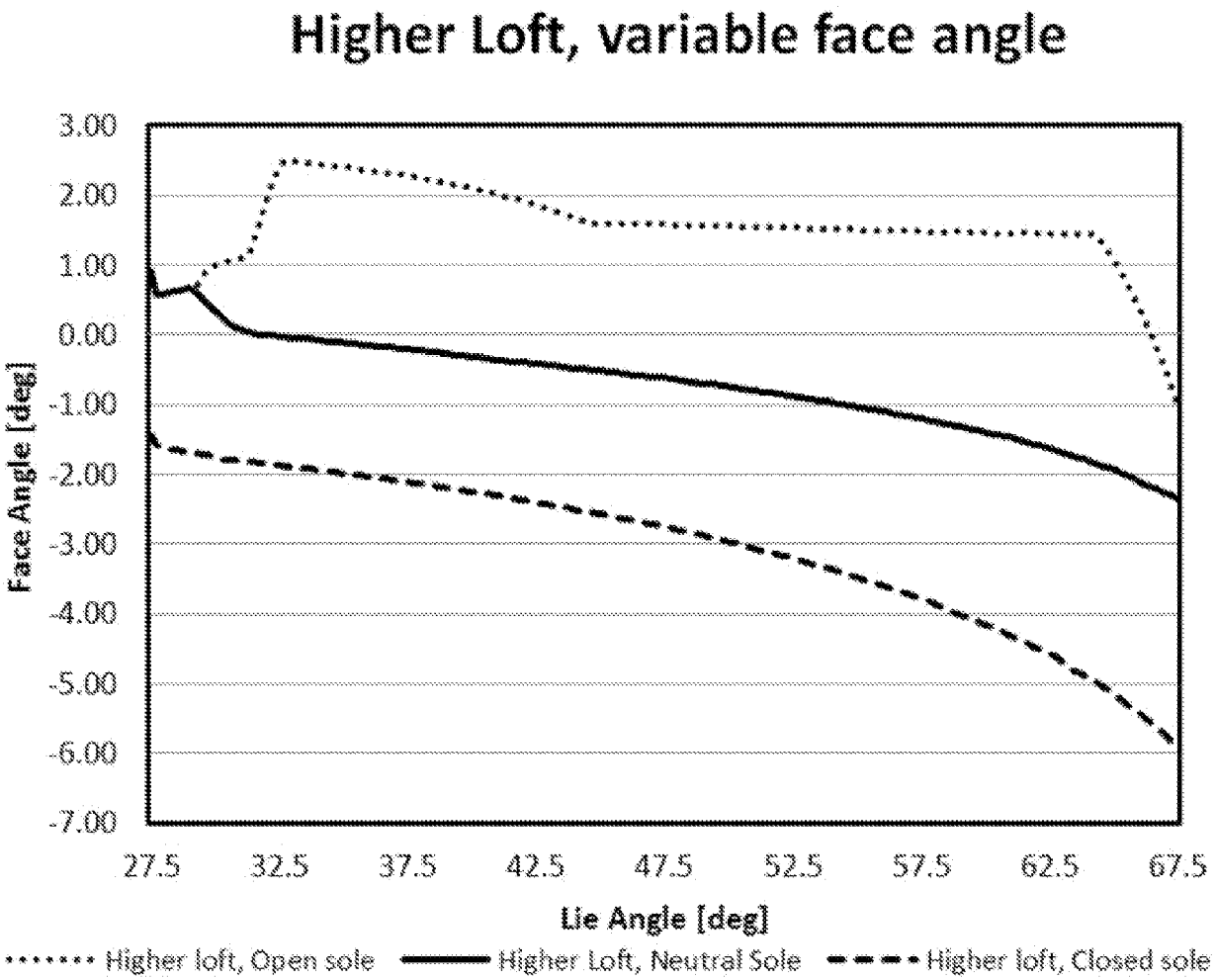

FIGS. 32-34 further illustrate that, at any combination of a given shaft-hosel connection setting and a given sole plate setting, the face angle of the club head can remain substantially constant over a range of lie angles. FIG. 32 illustrates face angle as a function of lie angle with the shaft-hosel connection set to a standard loft angle (e.g., about 9.5°), and for the three different sole plate-platform settings. For example, at the standard loft setting, over the lie angle range of from about 35° to about 60° the face angle can vary less than about 1.5° for each of the three sole plate settings shown, and less than about 0.5° in particular for the neutral sole setting.

FIG. 33 represents face angle as a function of lie angle with the shaft-hosel connection set to a lower loft angle (e.g., about 8°), and for three different sole plate settings. For example, at the lower loft angle setting, over the lie angle range of from about 35° to about 60° the face angle can vary less than about 1.5° for each of the three sole plate settings shown, and less than about 0.5° in particular for the closed sole setting.

FIG. 34 represents face angle as a function of lie angle with the shaft-hosel connection set to a higher loft angle (e.g., about 11°), and for three different sole plate settings. For example, at the higher loft angle setting, over the lie angle range of from about 35° to about 60° the face angle can vary less than about 2° for each of the three sole plate settings shown, and less than about 1° in particular for the open sole setting.

Some embodiments may not include a platform as described herein, and instead include a different mechanism for setting the pivot angle of the sole plate relative to the body. For example, the sole plate or the lower portion of the body can comprise an adjustable portion that can slide fore and aft to replace the functionality of a separate platform. As another example, a portion of the lower portion of the body can be adjustable to extend different heights below the body to set the sole plate to different pivot angles. In other embodiments, the lower portion of the body can comprise a stationary ramped platform or a stationary stepped platform, either affixed to or integral with the body. In such embodiments, the sole plate can be adjustable, such as forwardly and rearwardly, along the lower portion of the sole to cause an upper contact surface of the sole plate to contact different portions of the stationary platform while a front portion of the sole plate also moves along a relative flat portion of the lower surface of the body near the front of the body to create a second region of contact between the body and the sole plate, and thereby set a pivot angle of the sole plate relative to the body.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C" or "A, B and C." As used herein, the term "coupled" generally means physically coupled or linked and does not exclude the presence of intermediate elements between the coupled items absent specific contrary language.

In view of the many possible embodiments to which the principles of this disclosure may be applied, it should be recognized that the illustrated embodiments are only preferred examples and should not be taken as limiting the scope of the inventions. Rather, the scope of the invention is defined by the following claims. We therefore claim all that comes within the scope of these claims.

We claim:

1. A golf club head comprising:

a body having a front portion comprising a striking plate, a rear end, a toe, a heel, a crown, and a lower portion opposite the crown;

a sole plate coupled to the lower portion of the body and pivotably adjustable relative to the body about a pivot location adjacent to the front portion of the body; and a platform positioned between the sole plate and the lower portion of the body, the platform being adjustable to plural positions along the lower portion of the body to change a pivot angle between the sole plate and the body, wherein the platform is adjustable in generally frontward and rearward directions relative to the body.

2. The golf club head of claim 1, wherein the sole plate comprises a substantially cylindrical lower surface that is curved in a generally heel-toe direction.

3. The golf club head of claim 1, wherein the platform is adjustable along a continuous, non-discrete range of positions along the lower portion of the body.

4. The golf club head of claim 3, wherein the platform comprises a sloped lower engagement surface that engages an upper surface of the sole plate to set the pivot angle between the sole plate and the body.

5. The golf club head of claim 4, wherein the sloped lower engagement surface of the platform varies in the distance it extends below the lower portion of the body, with a forward portion of the lower engagement surface extending a smaller distance below the lower portion of the body relative to rearward portion of the lower engagement surface.

6. The golf club of claim 3, further comprising a drive screw threadably engaged with the platform, the drive screw being configured to move the platform forwardly and rearwardly along the continuous, non-discrete range of positions relative to the body when the drive screw is rotated.

7. The golf club of claim 6, wherein the drive screw is supported by the body such that the body restricts the drive screw from moving in a forward or a rearward direction relative to the body.

8. The golf club head of claim 1, wherein the platform is adjustable to a plurality of discrete different positions relative the body, each corresponding to a different pivot angle between the sole plate and the body.

9. The golf club head of claim 8, wherein the platform comprises at least one upper engagement feature, and the lower portion of the body comprises a plurality of registration features, and the at least one upper engagement feature of the platform is engagable with a different one or more of the plurality of registration features on the lower surface of the body to adjust the platform to each of the plurality of discrete different positions relative the body.

10. The golf club head of claim 1, wherein the platform comprises a plurality of steps that project different distances below the lower portion of the body.

11. The golf club head of claim 10, wherein the platform is adjustable to a plurality of discrete different positions relative the body, each corresponding to a different pivot angle between the sole plate and the body, and when the platform is positioned at each of the plurality of discrete different positions relative the body, a different one of the plurality of steps is engaged with an upper surface of the sole plate.

12. The golf club head of claim 1, wherein the sole plate is securable to the lower portion of the body at plural different pivot angles relative to the body via a fastener extending through the sole plate and into the body.

13. A golf club head comprising:

a body having a front portion comprising a striking plate, a rear end, a toe, a heel, a crown, and a lower portion opposite the crown;

a sole plate coupled to the lower portion of the body; and a platform positioned between the sole plate and the lower portion of the body, the platform being adjustable to plural positions between the lower portion of the body and the sole plate to change the orientation of the sole plate relative to the body and thereby adjust the face angle of the golf club head, wherein the platform is adjustable in generally frontward and rearward directions relative to the body.

14. The golf club head of claim 13, wherein the sole plate comprises a substantially cylindrical lower surface that is curved in a generally heel-toe direction.

15. The golf club head of claim 13, wherein the platform is adjustable along a continuous, non-discrete range of positions along the lower portion of the body.

16. The golf club head of claim 13, wherein the platform is adjustable to a plurality of discrete different positions relative the body.

17. A golf club head comprising:

a body having a front portion comprising a striking plate, a rear end, a toe, a heel, a crown, and a lower portion opposite the crown;

a sole plate coupled to the lower portion of the body and pivotably adjustable relative to the body about a pivot location adjacent to the front portion of the body; and a platform positioned between the sole plate and the lower portion of the body, the platform being adjustable to plural positions along the lower portion of the body to change a pivot angle between the sole plate and the body;

wherein the platform is adjustable along a continuous, non-discrete range of positions along the lower portion of the body, and wherein the platform comprises a sloped lower engagement surface that engages an upper surface of the sole plate to set the pivot angle between the sole plate and the body.

18. The golf club head of claim 17, wherein the sloped lower engagement surface of the platform varies in the distance it extends below the lower portion of the body, with a forward portion of the lower engagement surface extending a smaller distance below the lower portion of the body relative to rearward portion of the lower engagement surface.

19. The golf club head of claim 17, further comprising a drive screw threadably engaged with the platform, the drive screw being configured to move the platform forwardly and rearwardly along the continuous, non-discrete range of positions relative to the body when the drive screw is rotated.

20. The golf club head of claim 19, wherein the drive screw is supported by the body such that the body restricts the drive screw from moving in a forward or a rearward direction relative to the body.

* * * * *